US011058184B2

(12) United States Patent
Yamamoto et al.

(10) Patent No.: US 11,058,184 B2
(45) Date of Patent: Jul. 13, 2021

(54) FASTENING STRUCTURE FOR FOOTWEAR AND SHOE USING THE SAME

(71) Applicant: Mizuno Corporation, Osaka (JP)

(72) Inventors: Tetsuo Yamamoto, Osaka (JP); Iemasa Honda, Osaka (JP); Takahiro Tamegane, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 16/832,514

(22) Filed: Mar. 27, 2020

(65) Prior Publication Data

US 2020/0305555 A1 Oct. 1, 2020

(30) Foreign Application Priority Data

Mar. 29, 2019 (JP) ..... JP2019-066525

(51) Int. Cl.
*A43C 11/20* (2006.01)
*A43C 1/04* (2006.01)

(52) U.S. Cl.
CPC ..... *A43C 11/20* (2013.01); *A43C 1/04* (2013.01)

(58) Field of Classification Search
CPC ..... A43C 11/165; A43C 11/20; A43C 1/04; A43C 1/06
See application file for complete search history.

(56) References Cited

U.S. PATENT DOCUMENTS 4,870,761 A * 10/1989 Tracy ..... A43C 1/04 36/51
5,042,120 A * 8/1991 Nichols ..... A43C 1/04 24/713.2
5,184,378 A * 2/1993 Batra ..... A43C 1/04 24/714.6
5,271,130 A * 12/1993 Batra ..... A43B 23/0235 24/714.6
5,692,319 A * 12/1997 Parker ..... A43B 7/1495 36/114
5,692,320 A * 12/1997 Nichols ..... A43C 1/02 36/170
6,073,370 A * 6/2000 Okajima ..... A43B 5/04 36/50.1
D430,724 S * 9/2000 Matis ..... D2/969
6,128,835 A * 10/2000 Ritter ..... A43C 1/00 36/114
7,287,342 B2 * 10/2007 Keen ..... A43B 3/22 36/50.1

(Continued)

FOREIGN PATENT DOCUMENTS

JP 5523404 B 4/2014

*Primary Examiner* — Robert Sandy
*Assistant Examiner* — David M Upchurch
(74) *Attorney, Agent, or Firm* — Troutman Pepper Hamilton Sanders LLP; James E. Schutz; Micah B. Hensley

(57) ABSTRACT

In a fastening structure, a third guide member located on the medial side and a third guide member located on the lateral side overlap each other in a foot length direction of footwear as viewed in the foot length direction. A tightening member is guided such that intermediate portions of the tightening member, which are located on the medial and lateral sides, extend in a direction including a component of the foot length direction without crossing each other in a foot width direction of the footwear.

10 Claims, 7 Drawing Sheets

(56) References Cited

U.S. PATENT DOCUMENTS

| | | | | |
|---|---|---|---|---|
| 2005/0183288 | A1* | 8/2005 | Hull | A43B 23/24 36/54 |
| 2006/0117607 | A1* | 6/2006 | Pare | A43C 11/004 36/50.1 |
| 2011/0225843 | A1* | 9/2011 | Kerns | A43B 3/0052 36/50.1 |
| 2012/0151795 | A1* | 6/2012 | Ivester | A43C 1/06 36/83 |
| 2015/0257489 | A1* | 9/2015 | Trudel | A43C 11/20 24/68 SK |
| 2015/0289594 | A1* | 10/2015 | Rushbrook | A43B 3/0005 36/50.1 |
| 2017/0105489 | A1* | 4/2017 | Lovett | A43C 1/00 |
| 2020/0138145 | A1* | 5/2020 | Greenspan | A43C 7/08 |

* cited by examiner

FASTENING STRUCTURE FOR FOOTWEAR AND SHOE USING THE SAME

CROSS-REFERENCE TO RELATED APPLICATION

This application claims priority to Japanese Patent Application No. 2019-066525 filed on Mar. 29, 2019, the entire disclosure of which is incorporated by reference herein.

BACKGROUND

The present disclosure relates to fastening structures for footwear and shoes using the same.

For example, a fastening structure for a shoe as described in Japanese Patent No. 5523404 is conventionally proposed as a fastening structure for a shoe having a shoelace for holding a wearer's foot by a tensile force.

Japanese Patent No. 5523404 discloses a fastening structure for a shoe including a pair of shoelace folding-back portions provided on an upper and a shoelace that is guided by the shoelace folding-back portions. Each of the shoelace folding-back portions is comprised of a pair of shoelace insertion portions that are located away from each other in a foot length direction of the shoe. The shoelace is sequentially passed through the pair of shoelace insertion portions of one shoelace folding-back portion and sequentially passed through the pair of shoelace insertion portions of the other shoelace folding-back portion.

SUMMARY

In the fastening structure of Japanese Patent No. 5523404, the shoelace is guided so that its intermediate portion is passed through the pair of shoelace insertion portions of each shoelace folding-back portion and is folded back in a crisscross fashion. Accordingly, when the shoelace is in a tightened state, namely when a tensile force is applied to the shoelace, the intermediate portion of the shoelace folded back in the crisscross fashion holds a foot of a wearer wearing the shoe.

In the fastening structure of Japanese Patent No. 5523404, the intermediate portion of the shoelace has many local bends at positions where the intermediate portion is held by each shoelace folding-back portion (pair of shoelace insertion portions). Accordingly, frictional resistance tends to occur in the bends, and a tensile force applied to the shoelace is not easily directly transmitted to the shoelace. That is, the tensile force is not easily uniformly transmitted to the entire shoelace. Specifically, when the tensile force is increased, the intermediate portion of the shoelace is not easily tightened. When the tensile force is reduced from the tightened state, the tensile force is not immediately released and the intermediate portion of the shoelace is not easily loosened. It is therefore not easy and takes long for the wearer to put on and take off the shoe. Accordingly, in the fastening structure of Japanese Patent No. 5523404, the tightening member cannot be easily tightened and loosened.

The present disclosure was developed in view of the above circumferences and it is an object of the present disclosure to make it easy to tighten and loosen a tightening member without degrading the capability to hold a wearer's foot.

In order to achieve the above object, a first aspect of the present disclosure relates to a fastening structure for footwear. This fastening structure for the footwear includes: a tightening member that holds a foot of a wearer wearing the footwear by a tensile force; first guide members disposed at positions corresponding a medial side and a lateral side; second guide members disposed at positions corresponding to the medial side and the lateral side and each disposed behind a corresponding one of the first guide members; and third guide members disposed at positions corresponding to the medial side and the lateral side and each disposed between a corresponding one of the first guide members and a corresponding one of the second guide members in a foot length direction of the footwear. Each of the first to third guide members includes a body including a fixed end and a free end located closer to a middle in a foot width direction of the footwear than the fixed end is, and an insertion portion which is disposed on a side where the free end is located and through which the tightening member can be passed. An intermediate portion of the tightening member, which is located on the medial side, is sequentially passed through the insertion portion of the first guide member located on the medial side, the insertion portion of the third guide member located on the lateral side, and the insertion portion of the second guide member located on the medial side in this order. An intermediate portion of the tightening member, which is located on the lateral side, is sequentially passed through the insertion portion of the first guide member located on the lateral side, the insertion portion of the third guide member located on the medial side, and the insertion portion of the second guide member located on the lateral side in this order. The third guide member located on the medial side and the third guide member located on the lateral side overlap each other in the foot length direction as viewed in the foot length direction. The tightening member is guided such that the intermediate portions located on the medial and lateral sides extend in a direction including a component of the foot length direction without crossing each other in the foot width direction.

In the first aspect, the third guide member located on the medial side and the third guide member located on the lateral side overlap each other in the foot length direction as viewed in the foot length direction. The third guide member located on the medial side and the third guide member located on the lateral side are therefore continuous in the foot width direction, namely have no gap therebetween in the foot width direction. Accordingly, when the tightening member is in a tightened state, namely when a tensile force is being applied to the tightening member, the third guide members can firmly hold the wearer's foot in place.

In the first aspect, the tightening member is configured so that the intermediate portions located on the medial and lateral sides extend in the direction including the component of the foot length direction without crossing each other in the foot width direction. That is, the intermediate portions are configured to become closer to straight in the foot length direction. Frictional resistance is therefore less likely to occur between the intermediate portions of the tightening member and the insertion portions of the first to third guide members. A tensile force applied to the tightening member is therefore more easily directly transmitted to the intermediate portions of the tightening member. That is, the tensile force is more easily uniformly transmitted to the entire tightening member. Accordingly, by increasing the tensile force, the tightening member is more firmly tightened. By reducing the tensile force from the tightened state, the tensile force is immediately released, so that the tightening member is easily loosened from the tightened state. In the fastening structure, the tightening member can thus be easily tightened and loosened. It is therefore easier and takes less time for the wearer to put on and take off the footwear.

Accordingly, in the first aspect, the tightening member can be easily tightened and loosened without degrading the capability to hold the wearer's foot.

According to a second aspect, in the first aspect, the insertion portion of the third guide member is disposed approximately in the middle in the foot width direction of the footwear at a position near an imaginary line connecting the insertion portions of the first and second guide members that are located on an opposite side in the foot width direction of the footwear from the third guide member.

In the second aspect, the intermediate portion of the tightening member which is passed through the insertion portions of the first to third guide members is configured to become closer to straight in the foot length direction. Accordingly, a tensile force applied to the tightening member is more easily directly transmitted to the intermediate portion of the tightening member. The tightening member can thus be easily tightened and loosened.

According to a third aspect, in the first aspect, the third guide member is configured so that the body of the third guide member surface contacts an instep of the wearer's foot.

In the third aspect, the body of the third guide member surface contacts the instep of the wearer's foot. The body of the third guide member therefore provides a better fit on the instep of the wearer's foot when the tightening member is in the tightened state. Especially in the third guide members located on the medial and lateral sides, the portions of the bodies of the third guide members which are continuous with the insertion portions of the third guide members overlap each other in the foot length direction. These overlapping portions wrap around and properly hold the instep of the wearer's foot and thus provide an even better fit on the instep of the wearer's foot.

According to a fourth aspect, in the first aspect, the insertion portion of the third guide member has a loop shape extending in the foot length direction.

In the fourth aspect, the insertion portion of the third guide member has a loop shape extending in the foot length direction. The intermediate portion of the tightening member which is passed through the insertion portion of the third guide member is therefore more easily made to extend in the foot length direction. Accordingly, a tensile force applied to the tightening member is more easily directly transmitted to the intermediate portion. The tightening member can thus be easily tightened and loosened.

According to a fifth aspect, in the first aspect, the fastening structure for the footwear further includes a tightening closure that applies a tensile force to the tightening member and adjusts the tensile force.

In the fifth aspect, the tightening member can be easily tightened and loosened by operating the tightening closure.

A sixth aspect is a shoe including the fastening structure for the footwear of any one of the first to fifth aspects.

In the sixth aspect, the shoe having functions and effects similar to those of the first to fifth aspects can be obtained.

As described above, according to the present disclosure, the tightening member can be easily tightened and loosened without degrading the capability to hold the wearer's foot.

DETAILED DESCRIPTION

Figure 1:
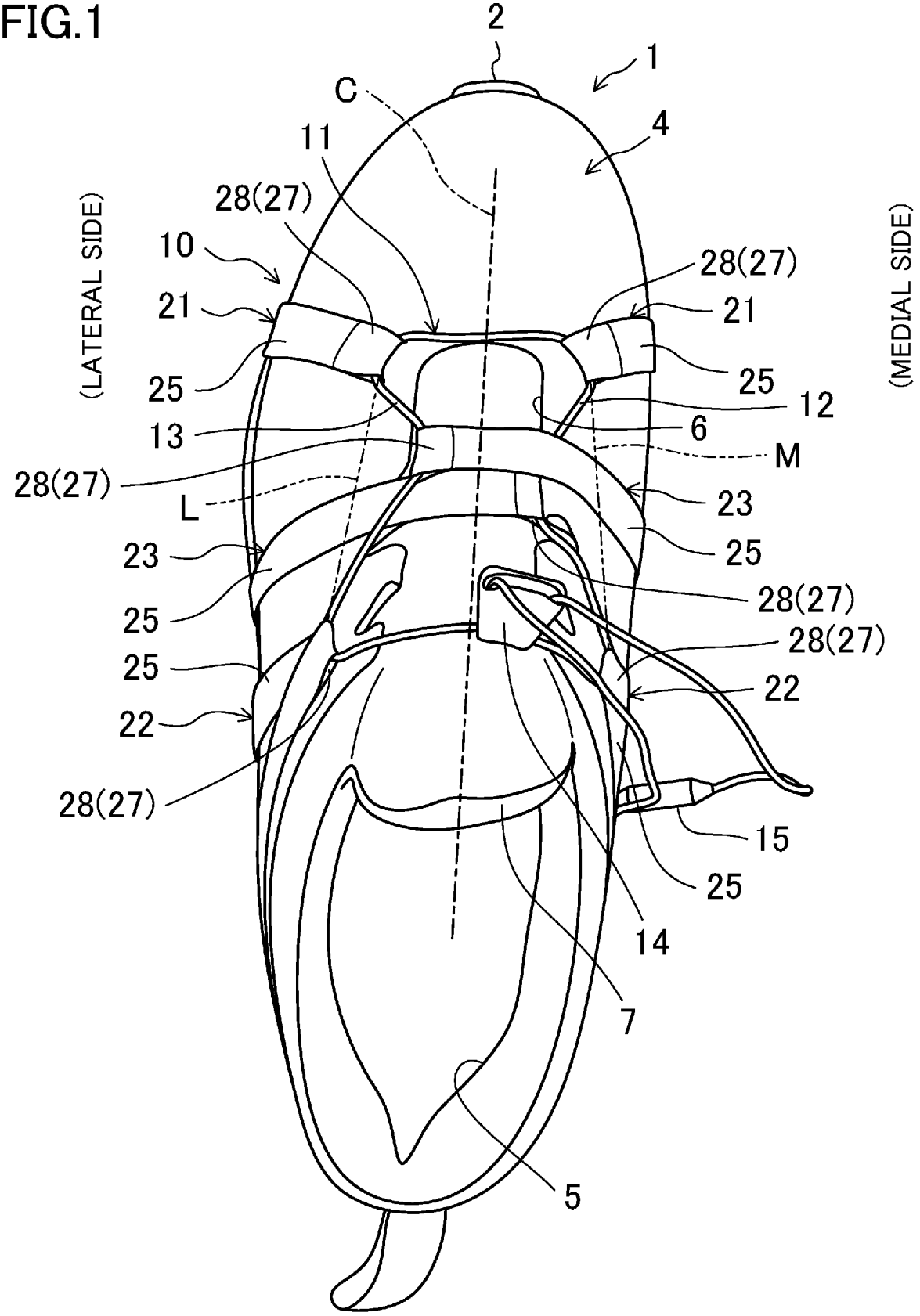
FIG. 1 is a plan view of a shoe having a fastening structure according to an embodiment of the present disclosure.
Figure 2:
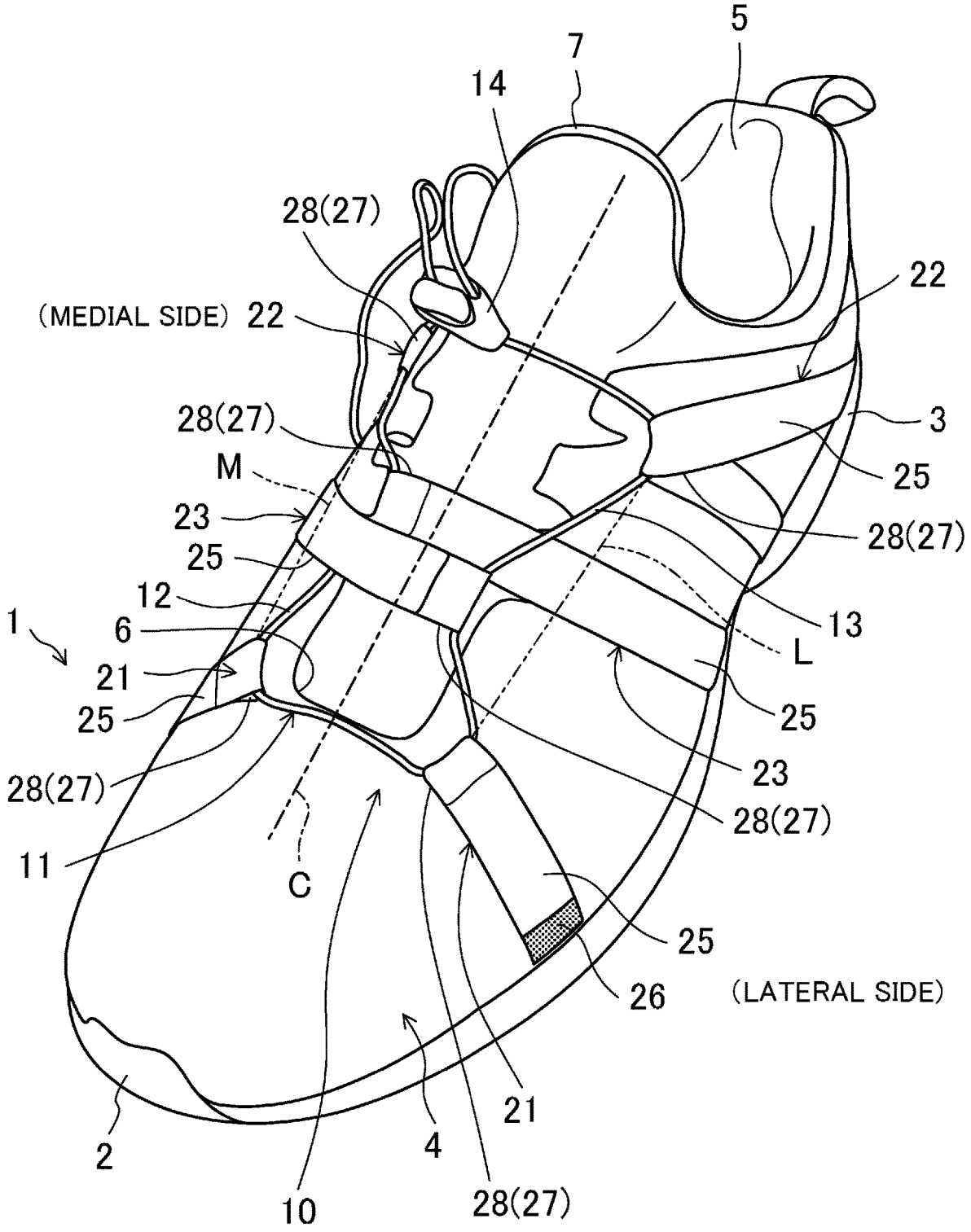
FIG. 2 is a perspective view of the shoe as viewed from the lateral side.
Figure 3:
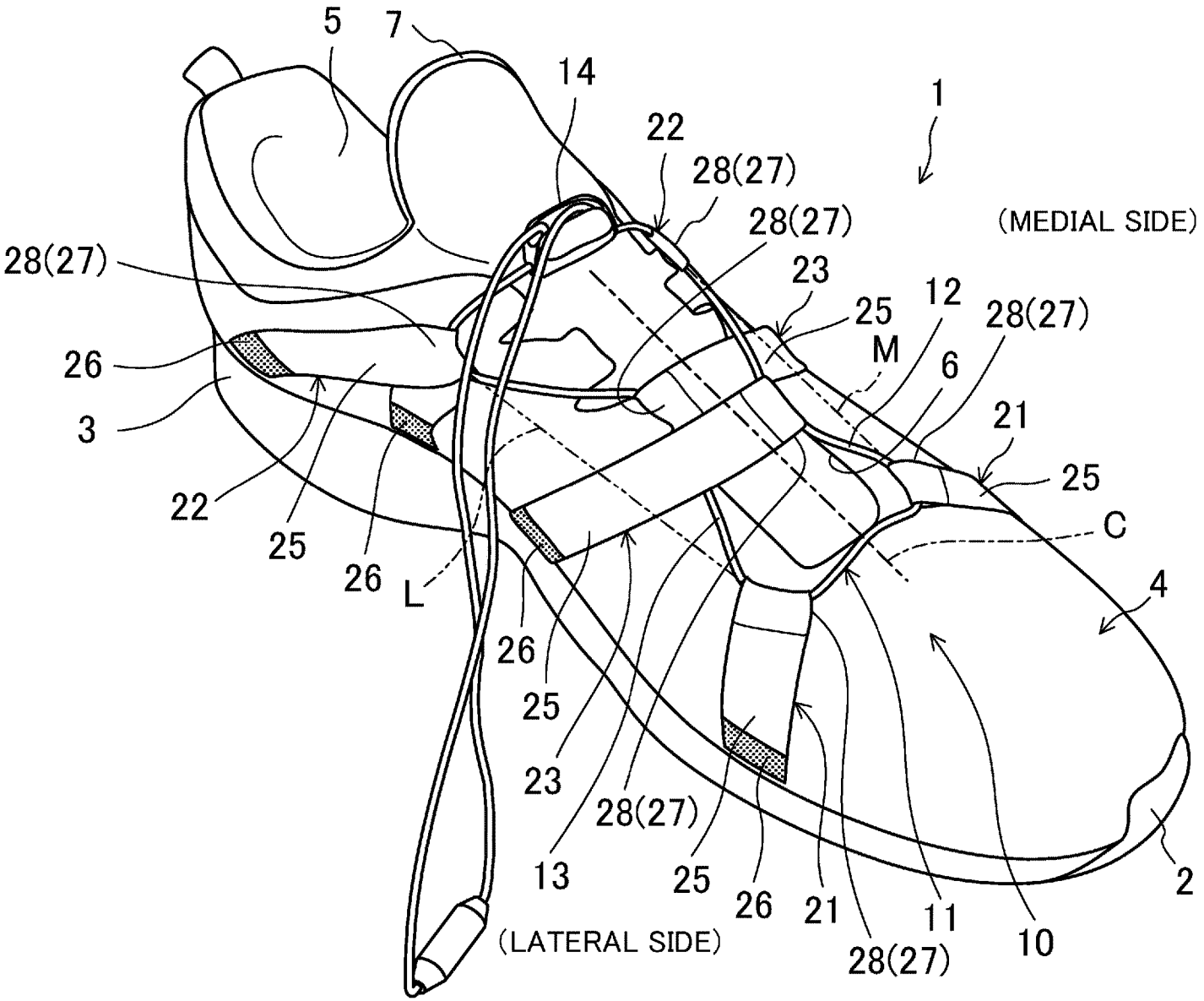
FIG. 3 is a perspective view of the shoe as viewed from the medial side.
Figure 4:
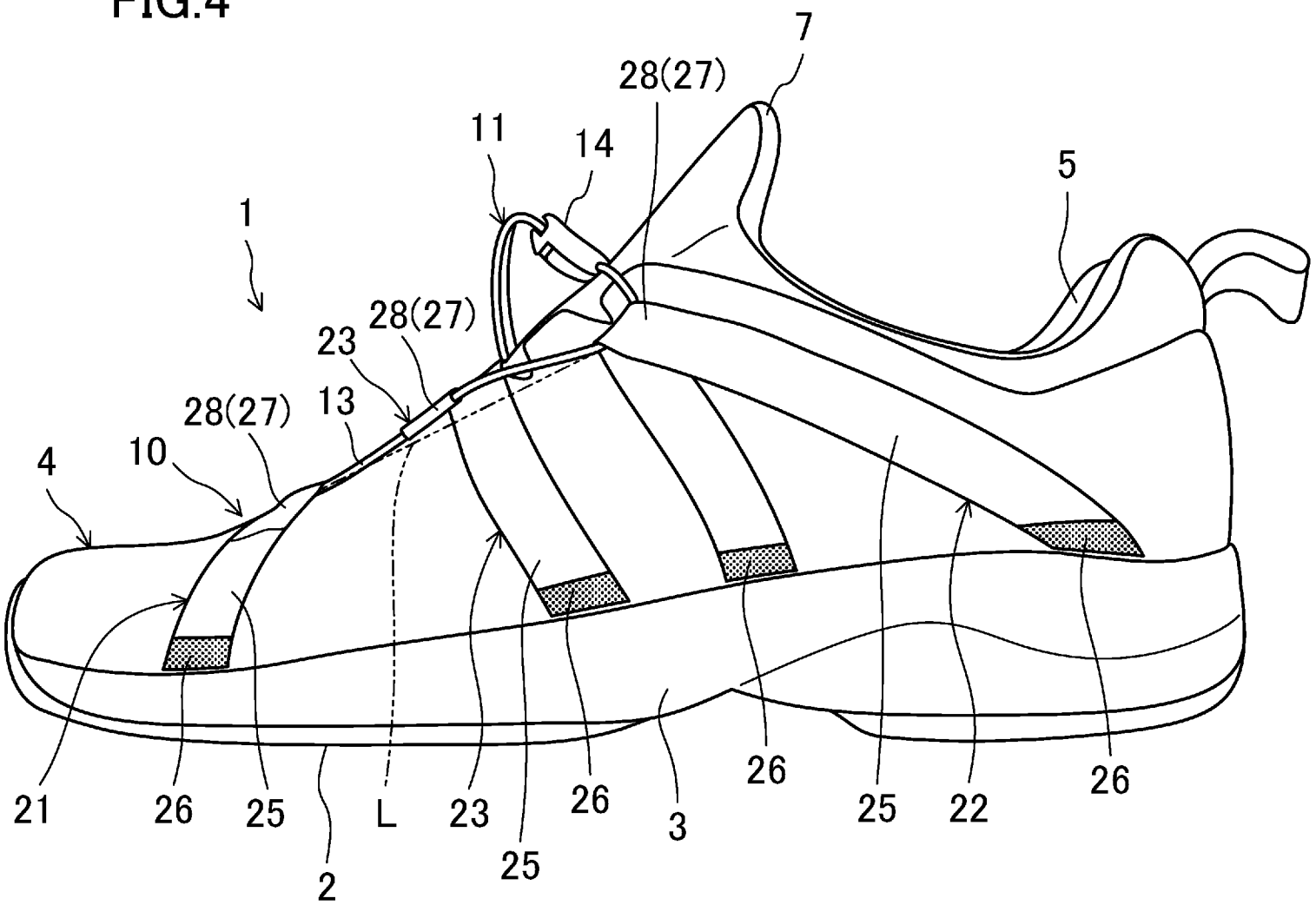
FIG. 4 is a side view of the shoe as viewed from the lateral side.
Figure 5:
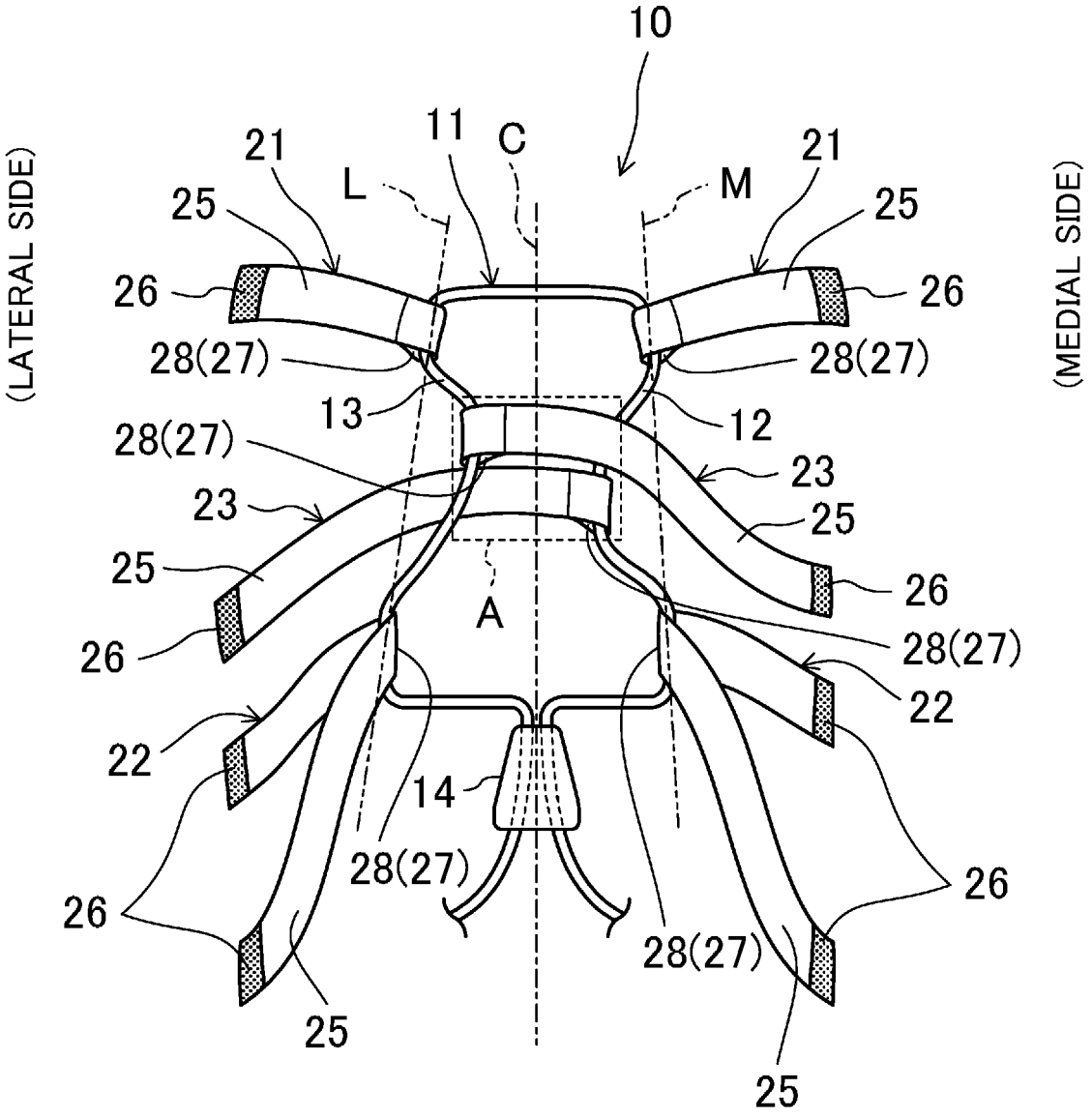
FIG. 5 is a plan view schematically illustrating the configuration of the fastening structure.

Embodiments of the present disclosure will be described in detail with reference to the accompanying drawings. The following description of the embodiments is merely illustrative in nature and is not intended to limit the invention, its application or uses.

FIGS. 1 to 4 generally illustrate a fastening structure 10 and a shoe 1 (footwear) having the fastening structure 10 according to an embodiment of the present disclosure. The shoe 1 is used as, e.g., a running shoe, a sports shoe for various sports, a casual sneaker, and a rehabilitation shoe.

The shoe 1 illustrated herein is a left shoe. A right shoe is configured symmetrically with the left shoe. Accordingly, in the following description, only the left shoe will be described, and description of the right shoe will be omitted.

In the following description, the terms "upper" and "lower" indicate relative positions in the vertical direction of the shoe 1, and the terms "front" and "rear" indicate relative positions in the foot length direction (front-rear direction) of the shoe 1. The terms "medial side" and "lateral side" indicate relative positions in the foot width direction of the shoe 1.

Outsole

As shown in FIGS. 1 to 4, the shoe 1 has an outsole 2. The outsole 2 is a hard elastic member that is harder than a midsole 3. Examples of a material suitable for the outsole 2 include thermoplastic resins such as ethylene-vinyl acetate copolymer (EVA), thermosetting resins such as polyurethane (PU), and rubber materials such as butadiene rubber and chloroprene rubber.

Midsole

The shoe 1 further has the midsole 3. The midsole 3 is made of a soft elastic material. Examples of the material suitable for the midsole 3 include thermoplastic synthetic resins such as ethylene-vinyl acetate copolymer (EVA) and their foams, thermosetting resins such as polyurethane (PU) and their foams, and rubber materials such as butadiene rubber and chloroprene rubber and their foams. The midsole 3 is placed on the outsole 2 via, e.g., an adhesive.

Upper Body

As shown in FIGS. 1 to 4, the shoe 1 has an upper body 4 that covers a wearer's foot. The peripheral edge of the lower part of the upper body 4 is fixedly attached to the entire peripheral edge of the midsole 3 by an adhesive etc.

The upper body 4 has in its upper part a foot insertion portion 5 and an opening 6. The foot insertion portion 5 is a portion into which the wearer's foot is to be inserted, and the opening 6 extends in the front-rear direction and communicates with the foot insertion portion 5. A tongue 7 for protecting the instep of the wearer's foot is disposed in the opening 6. The tongue 7 is integral with the upper body 4.

Fastening Structure

As shown in FIGS. 1 to 5, the fastening structure 10 includes a tightening member 11. The tightening member 11 is a member that is tightened on the shoe 1 (footwear) to hold the wearer's foot. The tightening member 11 is, e.g., a lace member or a wire made of a metal such as iron. How the tightening member 11 is guided by first to third guide members 21 to 23 will be specifically described later.

The tightening member 11 is provided on the upper body 4. The tightening member 11 is provided with a tightening closure 14 for applying a tensile force to the tightening member 11 and adjusting the tensile force. The tightening member 11 has connection portions 15 at its both ends. The connection portions 15 are connected together so that the tightening member 11 forms a single closed loop. The tightening closure 14 may be a dial tightening closure, not shown. The tightening closure 14 and the connection portions 15 may not be used, and a shoelace knot etc. may be tied using both ends of the tightening member 11.

Guide Members

The fastening structure 10 includes first guide members 21, second guide members 22, and third guide members 23.

The first guide members 21 are disposed at positions corresponding to the medial and lateral sides in the foot width direction of the shoe 1. The first guide members 21 are also disposed at positions corresponding to the front part of the opening 6 in the foot length direction of the shoe 1.

The second guide members 22 are disposed at positions corresponding to the medial and lateral sides in the foot width direction of the shoe 1. Each of the second guide members 22 is located at an interval behind a corresponding one of the first guide members 21 in the foot length direction. Specifically, the second guide members 22 are disposed such that their insertion portions 28, described later, are located at positions corresponding to the rear part of the opening 6 in the foot length direction.

The third guide members 23 are disposed at positions corresponding to the medial and lateral sides in the foot width direction of the shoe 1. Each of the third guide members 23 is located between a corresponding one of the first guide members 21 and a corresponding one of the second guide members 22 in the foot length direction. Specifically, the third guide members 23 are disposed at positions corresponding to the middle in the foot length direction of the opening 6.

Body

Each of the first to third guide members 21 to 23 has a body 25. The body 25 is made of, e.g., a flexible material such as cloth or leather. The body 25 has a fixed end 26 and a free end 27.

The body 25 generally has a strip shape and extends in a direction including a component of the foot width direction. Specifically, the body 25 of the first guide member 21 has a strip shape and extends rearward from the fixed end 26 toward approximately the middle in the foot width direction of the shoe 1. The body 25 of the second guide member 22 has a strip shape and extends forward from the fixed end 26 toward approximately the middle in the foot width direction of the shoe 1.

The body 25 of the third guide member 23 has a strip shape and extends from the fixed end 26 toward approximately the middle in the foot width direction of the shoe 1. The third guide member 23 is configured so that the strip-shaped body 25 surface contacts the instep of the wearer's foot. In the present embodiment, the body 25 of the third guide member 23 has the same width as the bodies 25 of the first and second guide members 21, 22.

Fixed End

Each of the fixed ends 26 is located on either the medial side or the lateral side of the shoe 1. The fixed ends 26 are fixed to the upper body 4 by, e.g., an adhesive or sewing. In FIGS. 2 to 5, the fixed ends 26 are shown dot-hatched in order to distinguish the fixed ends 26 from other elements.

The fixed ends 26 of the first to third guide members 21 to 23 located on the medial side are fixed to a portion of the lower part of the upper body 4 which faces toward the medial side. The fixed ends of the first to third guide members 21 to 23 located on the lateral side are fixed to a portion of the lower part of the upper body 4 which faces toward the lateral side.

Each of the second guide members 22 has two fixed ends 26. Specifically, the second guide members 22 are configured so that that the front fixed end 26 is located at a position corresponding to the midfoot of the wearer's foot and the rear fixed end 26 is located at a position corresponding to the rearfoot of the wearer's foot.

Free End

The free ends 27 are located closer to the middle in the foot width direction of the shoe 1 than the fixed ends 26 are. The free ends 27 are not fixed to the upper body 4. Each of the second guide members 22 is folded back approximately in the middle of the body 25, and the folded-back portion is the free end 27 of the second guide member 22.

Insertion Portion

Each of the first to third guide members 21 to 23 has the insertion portion 28 through which the tightening member 11 is passed. The insertion portion 28 is disposed on the side where the free end 27 is located. Each of the insertion portions 28 of the first guide members 21 is in a loop shape extending in a direction including a component of the foot length direction. Each of the second guide members 22 is folded back approximately in the middle of the body 25 as described above, and the folded-back portion (free end 27) of the second guide member 22 serves as the insertion portion 28. Each of the insertion portions 28 of the third guide members 23 has a loop shape extending in the foot length direction.

Each of the insertion portions 28 of the third guide members 23 is disposed near an imaginary line M or L connecting the insertion portions 28 of the first and second guide members 21, 22 that are located on the opposite side in the foot width direction of the shoe 1 from the third guide member 23. Specifically, the insertion portion 28 of the third guide member 23 located on the lateral side is disposed near the imaginary line M in the foot width direction, the imaginary line M being a line connecting the insertion portion 28 of the first guide member 21 located on the medial side and the insertion portion 28 of the second guide member 22 located on the medial side. The insertion portion 28 of the third guide member 23 located on the medial side is disposed near the imaginary line L in the foot width direction, the imaginary line L being a line connecting the insertion portion 28 of the first guide member 21 located on the lateral side and the insertion portion 28 of the second guide member 22 located on the lateral side.

The insertion portions 28 of the third guide members 23 are disposed between the imaginary line M on the medial side and the imaginary line L on the lateral side in the foot width direction. More specifically, the insertion portion 28 of the third guide member 23 located on the lateral side is located between a centerline C extending in the foot length direction and the imaginary line M on the medial side in the foot width direction. The insertion portion 28 of the third guide member 23 located on the medial side is located between the centerline C and the imaginary line L on the lateral side in the foot width direction.

How Tightening Member is Guided

An intermediate portion 12 of the tightening member 11, which is located on the medial side, is passed through the insertion portion 28 of the first guide member 21 located on the medial side, the insertion portion 28 of the third guide member 23 located on the lateral side, and the insertion portion 28 of the second guide member 22 located on the medial side. When a tensile force is applied to the tightening member 11, the intermediate portion 12 of the tightening member 11 is subjected to a tensile force toward the medial side by the first and second guide members 21, 22 located on the medial side. The third guide member 23 located on the lateral side is thus pulled toward the medial side by this force.

An intermediate portion 13 of the tightening member 11, which is located on the lateral side, is passed through the insertion portion 28 of the first guide member 21 located on the lateral side, the insertion portion 28 of the third guide member 23 located on the medial side, and the insertion portion 28 of the second guide member 22 located on the lateral side. When a tensile force is applied to the tightening member 11, the intermediate portion 13 of the tightening member 11 is subjected to a tensile force toward the lateral side by the first and second guide members 21, 22 located on the lateral side. The third guide member 23 located on the medial side is thus pulled toward the lateral side by this force.

Characteristic Configuration of Present Disclosure

A feature of the present disclosure is that the third guide member 23 located on the medial side and the third guide member 23 located on the lateral side overlap each other in the foot length direction as viewed in the foot length direction. Specifically, the third guide member 23 located on the medial side and the third guide member 23 located on the lateral side are disposed such that their bodies 25, 25 overlap each other in the foot length direction approximately in the middle in the foot length direction of the shoe 1 (see the area A enclosed by dashed line in FIG. 5). The tightening member 11 is guided such that the intermediate portions 12, 13 extend in a direction including the component of the foot length direction without crossing each other in the foot width direction.

Functions and Effects of Embodiment

As described above, in the fastening structure 10, the third guide member 23 located on the medial side and the third guide member 23 located on the lateral side overlap each other in the foot length direction as viewed in the foot length direction. The third guide member 23 located on the medial side and the third guide member 23 located on the lateral side are therefore continuous in the foot width direction, namely have no gap therebetween in the foot width direction. Accordingly, when the tightening member 11 is in a tightened state, namely when a tensile force is being applied to the tightening member 11, the third guide members 23 can firmly hold the wearer's foot in place.

The tightening member 11 is configured so that the intermediate portions 12, 13 located on the medial side and the lateral side extend in the direction including the component of the foot length direction without crossing each other in the foot width direction. That is, the intermediate portions 12, 13 are configured to become closer to straight in the foot length direction. Frictional resistance is therefore less likely to occur between the intermediate portions 12, 13 and the insertion portions 28 of the first to third guide members 21 to 23. A tensile force applied to the tightening member 11 is therefore more easily directly transmitted to the intermediate portions 12, 13. That is, the tensile force is more easily uniformly transmitted to the entire tightening member 11. Accordingly, by increasing the tensile force, the tightening member 11 is more firmly tightened. By reducing the tensile force from the tightened state, the tensile force is immediately released, so that the tightening member 11 is easily loosened from the tightened state. In the fastening structure 10, the tightening member 11 can thus be easily tightened and loosened. It is therefore easier and takes less time for the wearer to put on and take off the footwear.

In the fastening structure 10 of the embodiment of the present disclosure, the tightening member 11 can be easily tightened and loosened without degrading the capability to hold the wearer's foot.

Each of the insertion portions 28 of the third guide members 23 is disposed approximately in the middle in the foot width direction of the shoe 1 at a position near the imaginary line M or L connecting the insertion portions 28 of the first and second guide members 21, 22 that are located on the opposite side in the foot width direction of the shoe 1 from the third guide member 23. That is, the intermediate portions 12, 13 of the tightening member 11 which are passed through the insertion portions 28 of the first to third guide members 21 to 23 are configured to become closer to straight in the foot length direction. Accordingly, a tensile force applied to the tightening member 11 is more easily directly transmitted to the intermediate portions 12, 13. The tightening member 11 can thus be easily tightened and loosened.

The bodies 25 of the third guide members 23 surface contact the instep of the wearer's foot. The bodies 25 of the third guide members 23 therefore provide a better fit on the instep of the wearer's foot when the tightening member 11 is in the tightened state. Especially in the third guide members 23 located on the medial side and the lateral side, the portions of the bodies 25 of the third guide members 23 which are continuous with the insertion portions 28 of the third guide members 23 overlap each other in the foot length direction. These overlapping portions wrap around and properly hold the instep of the wearer's foot and thus provide an even better fit on the instep of the wearer's foot.

The insertion portions 28 of the third guide members 23 have a loop shape extending in the foot length direction. The intermediate portions 12, 13 of the tightening member 11 which are passed through the insertion portions 28 of the third guide members 23 are therefore more easily made to extend in the foot length direction. Accordingly, a tensile force applied to the tightening member 11 is more easily directly transmitted to the intermediate portions 12, 13. The tightening member 11 can thus be easily tightened and loosened.

The tightening member 11 can be easily tightened and loosened by operating the tightening closure 14 for applying a tensile force to the tightening member 11 and adjusting the tensile force.

First Modification of Embodiment

Figure 6:
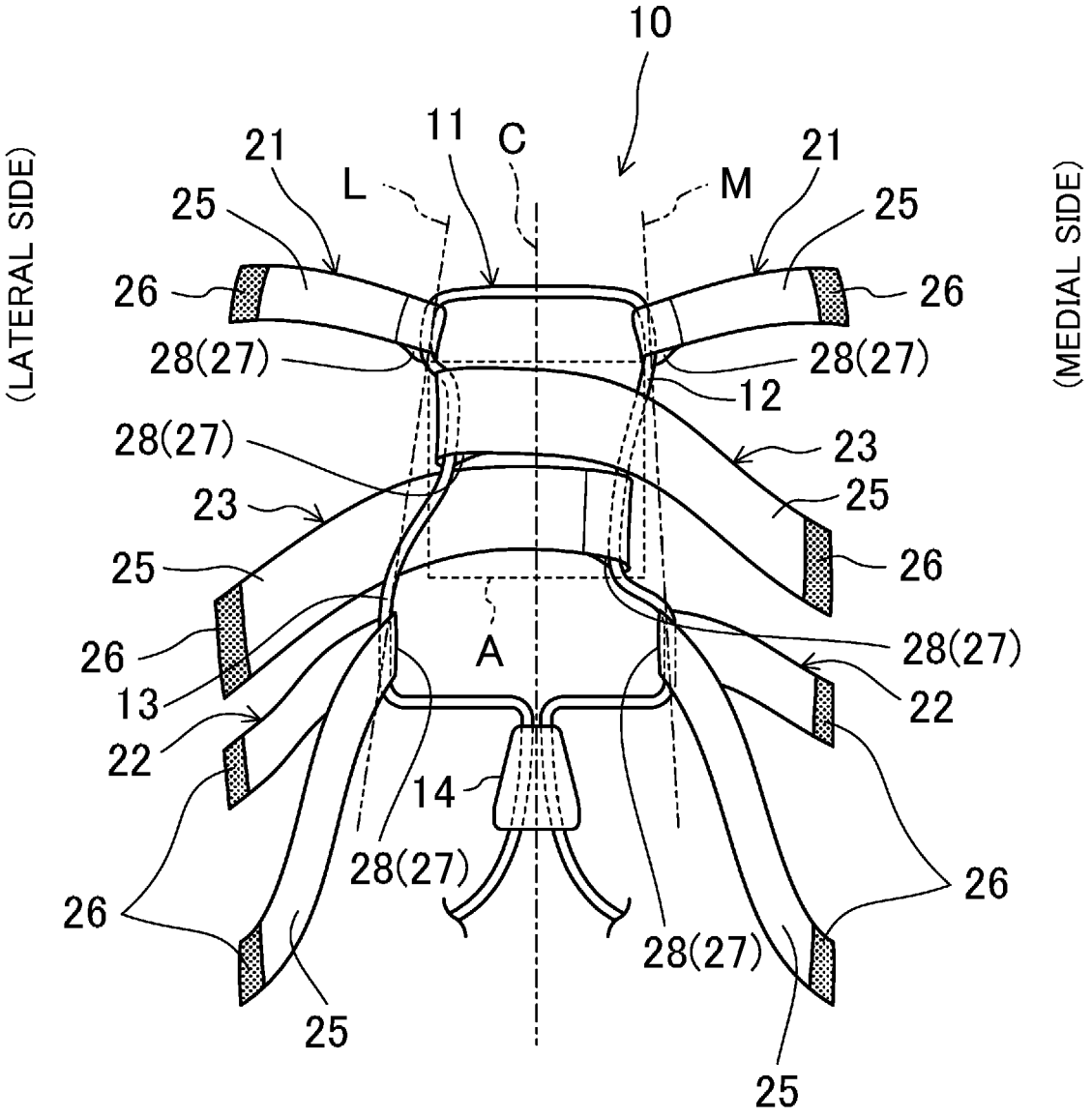
FIG. 6 is a plan view corresponding to FIG. 5, schematically illustrating the configuration of a fastening structure according to a first modification.

The above embodiment illustrates the form in which the bodies 25 of the third guide members 23 have the same width as the bodies 25 of the first and second guide members 21, 22. However, the present disclosure is not limited to this form. For example, as in a first modification shown in FIG. 6, the bodies 25 of the third guide members 23 may have a greater width than the bodies 25 of the first and second guide members 21, 22.

In this modification, the area of the portions of the bodies 25 of the third guide members 23 which surface contact the instep of the wearer's foot is relatively increased. Accordingly, when the tightening member 11 is in the tightened state, the bodies 25 of the third guide members 23 wrap around and properly hold the instep of the wearer's foot and thus provide an even better fit on the instep of the wearer's foot.

Second Modification of Embodiment

Figure 7:
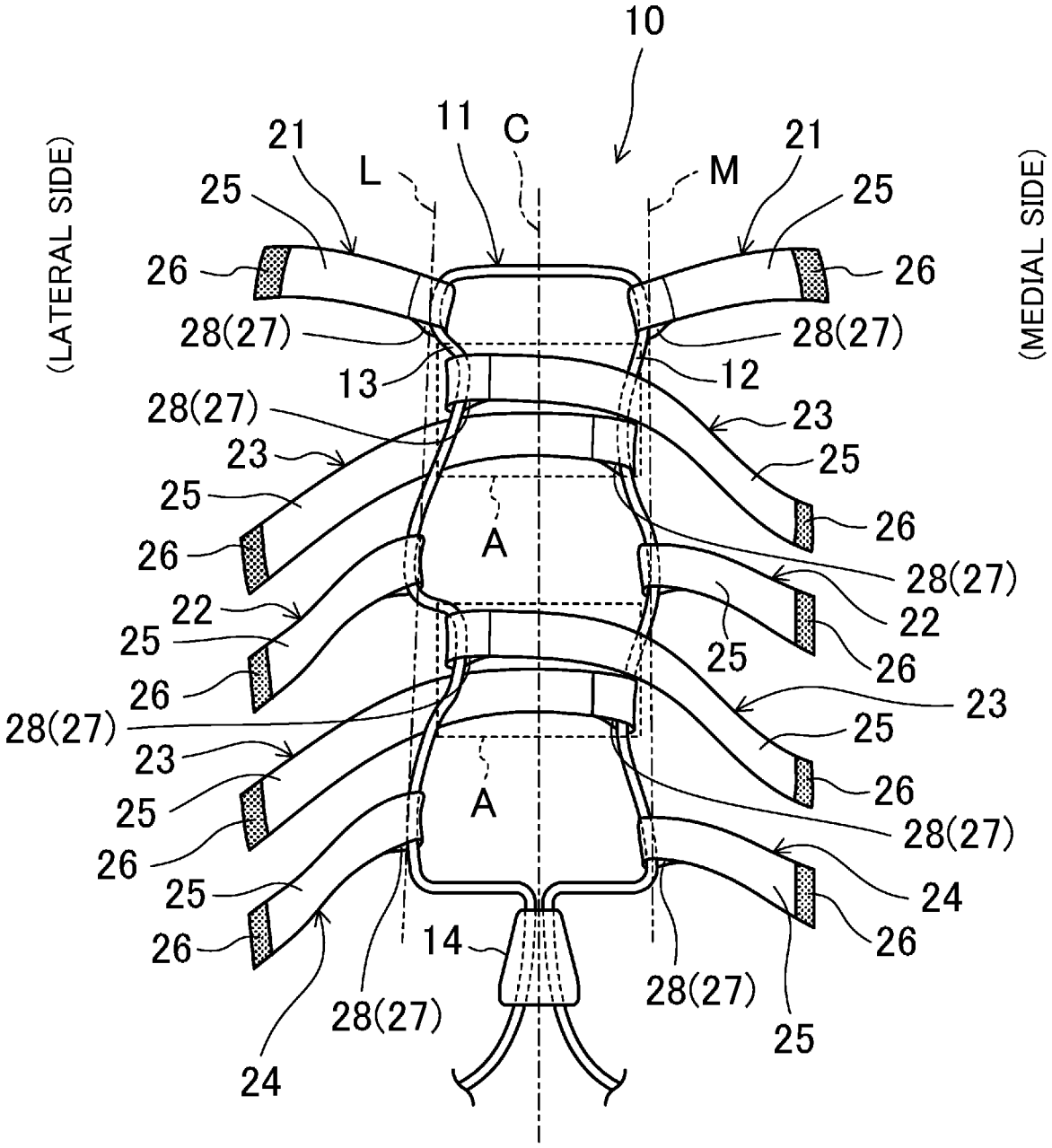
FIG. 7 is a plan view corresponding to FIG. 5, schematically illustrating the configuration of a fastening structure according to a second modification.

The above embodiment illustrates the form in which one third guide member 23 is provided on each of the medial and lateral sides. However, the present disclosure is not limited to this. A plurality of third guide members 23 may be provided on each of the medial and lateral sides. For example, as in a second modification shown in FIG. 7, another third guide member 23 may be disposed behind the second guide member 22 on each of the medial and lateral sides. It is preferable to displace a fourth guide member 24 behind the another third guide member 23. The fourth guide member 24 has a configuration similar to that of the second guide member 22. In this modification, each of the second guide members 22 has only one fixed end 26 instead of the configuration illustrated in the above embodiment (the configuration in which each of the second guide members 22 has two fixed ends 26).

Even in such a modification, the intermediate portions 12, 13 of the tightening member 11 are configured to become closer to straight in the foot length direction. Accordingly, as in the above embodiment, the tightening member 11 can be easily tightened and loosened without degrading the capability to hold the wearer's foot.

Other Embodiments

The above embodiment illustrates the form in which the bodies 25 of the first to third guide members 21 to 23 generally has a strip shape. However, the present disclosure is not limited to this form. For example, the bodies 25 of the first to third guide members 21 to 23 may have generally a line shape and extend in a direction including the component of the foot width direction.

The above embodiment illustrates the form in which the fixed ends 26 of the first to third guide members 21 to 23 are fixed to the lower part of the upper body 4. However, the present disclosure is not limited to this form. For example, the fixed ends 26 may be fixed to either or both of the outsole 2 and the midsole 3.

The above embodiment illustrates the form in which the fastening structure 10 is applied to the shoe 1. However, the present disclosure is not limited to this form. The fastening structure 10 may be applied to a slipper or a sandal. The fastening structure 10 of the present disclosure is applicable to footwear.

Although the embodiments of the present disclosure are described above, the present disclosure is not limited to the above embodiments, and various modifications can be made without departing from the spirit and scope of the invention.

The present disclosure is industrially applicable as a fastening structure that is applied to footwear such as a shoe.

What is claimed is:

1. A fastening structure for footwear, comprising:

a tightening member that holds a foot of a wearer wearing the footwear by a tensile force;

first guide members disposed at positions corresponding a medial side and a lateral side;

second guide members disposed at positions corresponding to the medial side and the lateral side and each disposed behind a corresponding one of the first guide members; and third guide members disposed at positions corresponding to the medial side and the lateral side and each disposed between a corresponding one of the first guide members and a corresponding one of the second guide members in a foot length direction of the footwear, wherein each of the first to third guide members includes a body including a fixed end and a free end located closer to a middle in a foot width direction of the footwear than the fixed end is, and an insertion portion which is disposed on a side where the free end is located and through which the tightening member can be passed, an intermediate portion of the tightening member, which is located on the medial side, is sequentially passed through the insertion portion of the first guide member located on the medial side, the insertion portion of the third guide member located on the lateral side, and the insertion portion of the second guide member located on the medial side in this order, an intermediate portion of the tightening member, which is located on the lateral side, is sequentially passed through the insertion portion of the first guide member located on the lateral side, the insertion portion of the third guide member located on the medial side, and the insertion portion of the second guide member located on the lateral side in this order, the third guide member located on the medial side and the third guide member located on the lateral side overlap each other in the foot length direction as viewed in the foot length direction, and the tightening member is guided such that the intermediate portions located on the medial and lateral sides extend in a direction including a component of the foot length direction without crossing each other in the foot width direction.

2. The fastening structure for the footwear of claim 1, wherein for each third guide member, the insertion portion of the third guide member is disposed approximately in the middle in the foot width direction of the footwear at a position near an imaginary line connecting the insertion portions of the first and second guide members that are located on an opposite side in the foot width direction of the footwear from the third guide member.

3. The fastening structure for the footwear of claim 1, wherein a third guide member of the third guide members is configured so that the body of the third guide member surface contacts an instep of the wearer's foot.

4. The fastening structure for the footwear of claim 1, wherein the insertion portion of each third guide member has a loop shape extending in the foot length direction.

5. The fastening structure for the footwear of claim 1, further comprising:

a tightening closure that applies a tensile force to the tightening member and adjusts the tensile force.

6. A shoe comprising the fastening structure for the footwear of claim 1.

7. A shoe comprising the fastening structure for the footwear of claim 2.

8. A shoe comprising the fastening structure for the footwear of claim 3.

9. A shoe comprising the fastening structure for the footwear of claim 4.

10. A shoe comprising the fastening structure for the footwear of claim 5.

* * * * *